US012137825B1

(12) United States Patent
Brown

(10) Patent No.: US 12,137,825 B1
(45) Date of Patent: Nov. 12, 2024

(54) UNDERWEAR DONNING DEVICE, SYSTEM AND METHOD

(71) Applicant: Anna-Marie Brown, Spring Creek, NV (US)

(72) Inventor: Anna-Marie Brown, Spring Creek, NV (US)

( * ) Notice: Subject to any disclaimer, the term of this patent is extended or adjusted under 35 U.S.C. 154(b) by 0 days.

(21) Appl. No.: 18/142,528

(22) Filed: May 2, 2023

(51) Int. Cl.
*A47G 25/90* (2006.01)

(52) U.S. Cl.
CPC ..... *A47G 25/90* (2013.01)

(58) Field of Classification Search
CPC .... A47G 25/90; A47G 25/905; A47G 25/907; A41D 13/00
USPC ..... D2/641
See application file for complete search history.

(56) References Cited

U.S. PATENT DOCUMENTS 4,579,538 A * 4/1986 Bass ..... A63H 3/16 446/107
5,607,448 A * 3/1997 Stahl ..... A61B 17/1322 606/203
6,536,636 B1 * 3/2003 McDonniel ..... A47G 25/905 223/111
10,682,001 B2 * 6/2020 Herzig ..... A47G 25/905

FOREIGN PATENT DOCUMENTS

DE 202022001859 U1 * 11/2022
FR 1164426 A * 10/1958
NL 9000361 A * 9/1991 ..... A47G 25/905
WO WO-2012032459 A1 * 3/2012 ..... A47G 25/905

* cited by examiner

*Primary Examiner* — Ismael Izaguirre
(74) *Attorney, Agent, or Firm* — Goodman Law Center, P.C.

(57) ABSTRACT

A device, system and method for assisting in putting on a lower body garment on a user is disclosed herein. The device includes an annular body, which in some embodiments includes an accordion-like configuration, that is adapted to be inserted within a waistband of the lower body garment and expanded to temporarily widen the waistband of the underwear or lower body garment. As such, a user (or caregiver) is able to easily pull the underwear over the widest and/or the lowest part of the lower body of the user (for example, the buttocks or the feet).

15 Claims, 10 Drawing Sheets

UNDERWEAR DONNING DEVICE, SYSTEM AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of adaptation devices for the elderly and disabled of existing art and more specifically relates to a device to aid the elderly and persons with disabilities in putting on underwear or other lower body garments.

RELATED ART

As people age, they may experience physical limitations that can make it difficult to perform everyday tasks, including getting dressed. For many elderly and disabled individuals, pulling up their underwear or other lower body garments can be particularly challenging. This can be due to a variety of factors, including reduced strength, flexibility, and mobility. Additionally, conditions such as arthritis or other joint disorders can make it painful to reach down and manipulate clothing. Attempts have been made in the art to provide specialized clothing and devices to assist in the pulling up of clothing. Despite these attempts, the challenge of getting underwear over the buttocks, or the widest part of the lower body, still remains a significant issue for elderly and disabled individuals. Therefore, a suitable solution is needed.

SUMMARY OF THE INVENTION

In view of the foregoing disadvantages inherent in the known adaptation devices art, the present disclosure provides a novel underwear donning device, system and method. The general purpose of the present disclosure, which will be described subsequently in greater detail, is to provide a device used by elderly and disabled users for aiding in putting on lower body garments; particularly, underwear.

A device for use in assisting a user in putting on a lower body garment is disclosed herein. In some embodiments, the device may include a generally annular body including a central opening having a diameter. The generally annular body may be defined by a plurality of movable members. The plurality of movable members may be interconnected together in such a way as to be mobile relative each other to enable radial movement of the generally annular body between an expanded position and a retracted position. In the expanded position, the diameter of the central opening may be of a size to accommodate a widest part (circumference) of a lower body of the user.

According to another embodiment, a method of putting on a lower body garment on a user is also disclosed herein. The method may comprise the steps of: providing the device as above; inserting the device into a waistband of the lower body garment when in the retracted position; radially expanding the generally annular body into the expanded position whereby the diameter of the central opening is of a size to accommodate a widest part of a lower body of the user; inserting legs of the user through leg holes of the lower body garment; grasping the device at the waistband of the lower body garment; pulling the lower body garment up and over the widest part of the lower body of the user; removing the device from the waistband of the lower body garment; and removing the device from the user.

According to another embodiment, an underwear donning system is also disclosed herein. The underwear donning system may comprise an underwear garment and a device. The underwear garment may include a waistband and a pair of leg holes and the device may be as described above, wherein the device includes the generally annular body defined by the plurality of movable members. The generally annular body may be disposed in the waistband of the underwear garment and held therein via a tear-away seam.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments for the present disclosure, an underwear donning device, system and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to an adaptation device for the elderly and disabled; and more particularly to an underwear donning device, system and method. Generally, the device may include a ring shape that is configured to be inserted into a waistband of underwear (or other lower body garment) and used to temporarily widen the waistband of the underwear so that a user is able to easily get the underwear over a widest part of the lower body of the user (for example, the buttocks). To achieve this, the device may be movable between a retracted position and an expanded position. In the expanded position, the device temporarily widens the waistband; in the retracted position, the device is compact.

Figure 1:
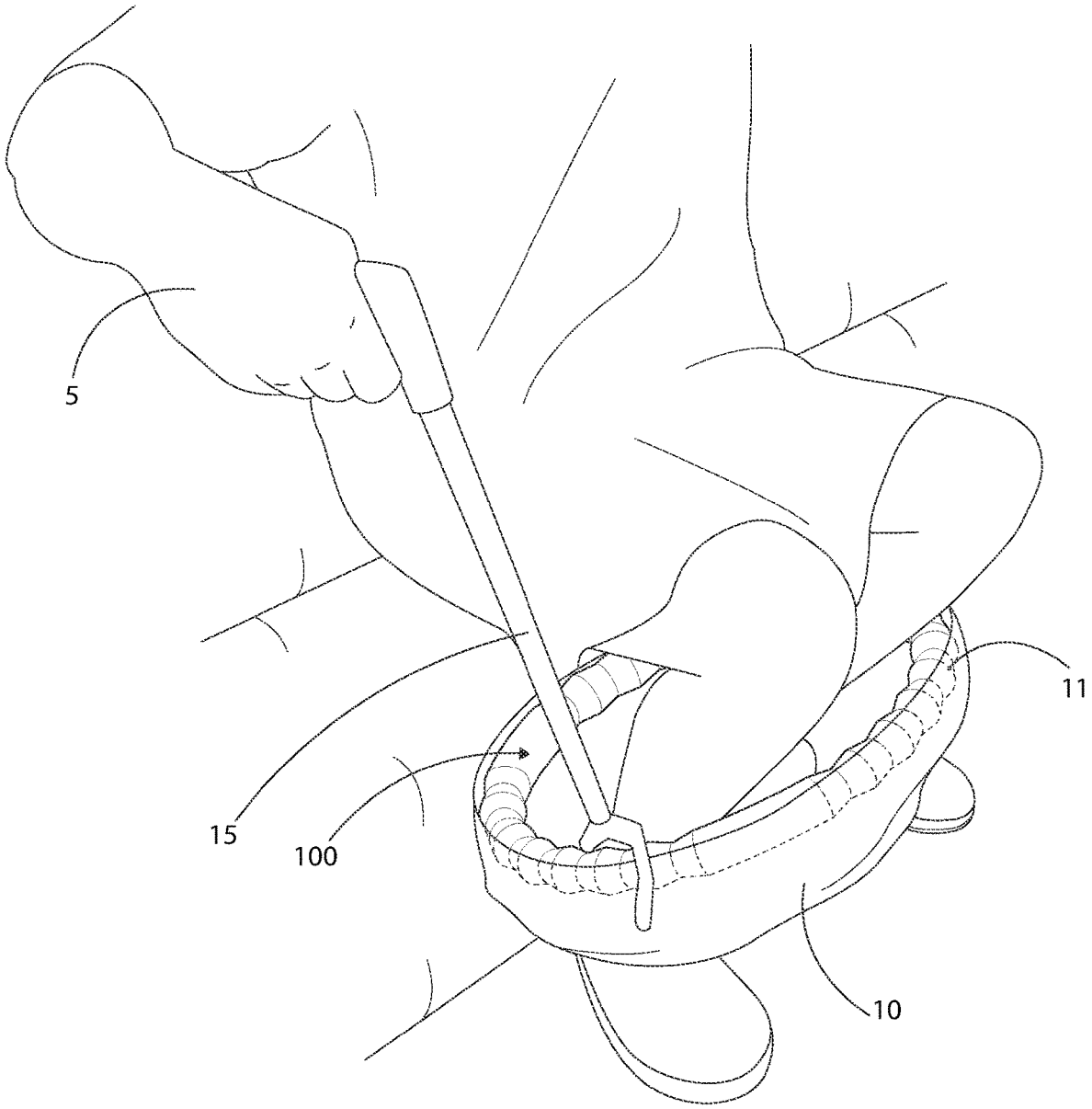
FIG. 1 is a front perspective view of a device being used for assisting a user in putting on a lower body garment from a seated position, according to an embodiment of the disclosure.
Figure 2:
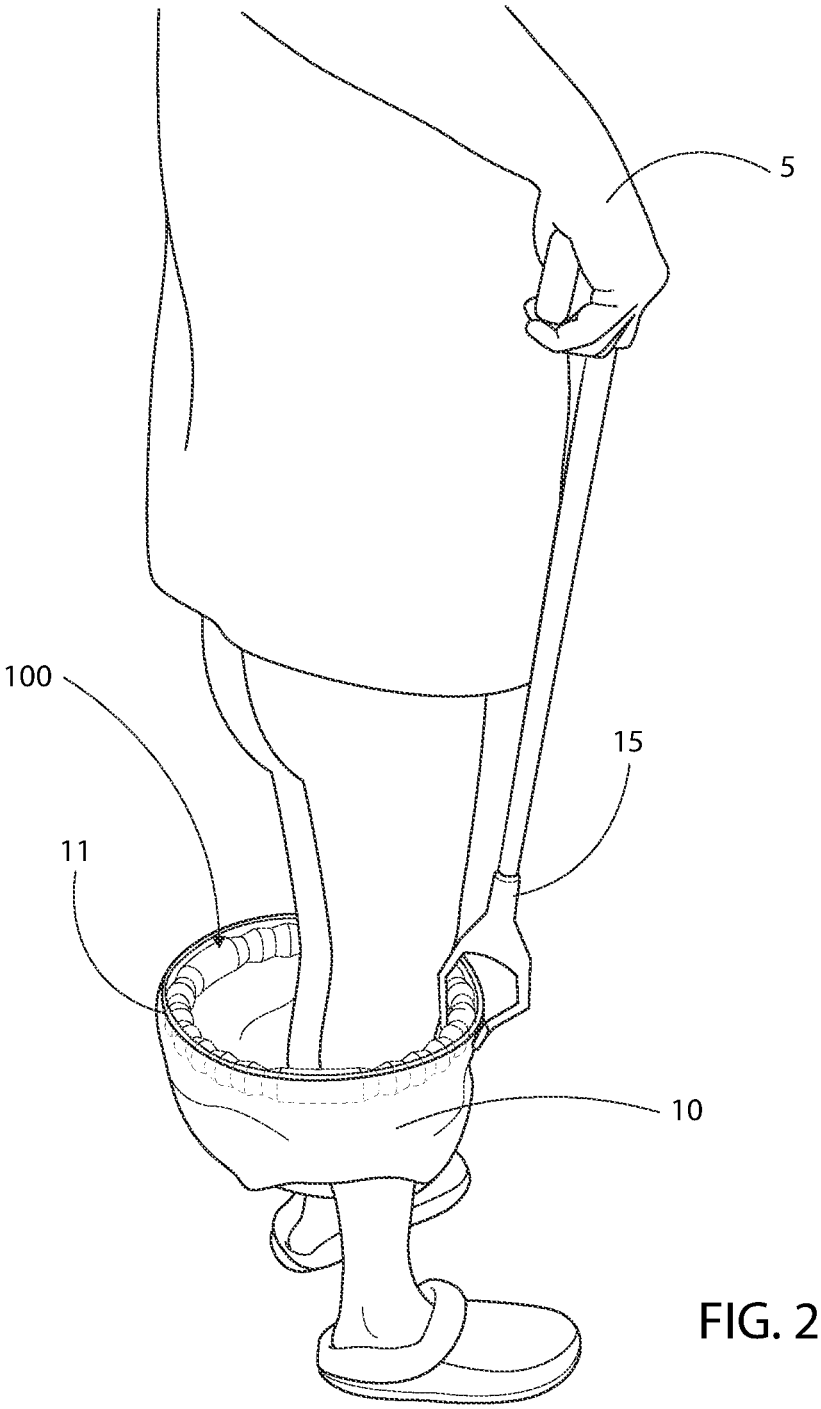
FIG. 2 is a side perspective view of a device being used for assisting a user in putting on the lower body garment from a standing position, according to an embodiment of the disclosure.

Referring now more specifically to the drawings by numerals of reference, there is shown in FIGS. 1-10, various views of a device 100. As shown in FIGS. 1-2, the device 100 may be used for assisting a user in putting on a lower body garment 10, such as underwear, from either a seated position or a standing position. For example, the device 100 may be used with disposable underwear (e.g., diapers) to assist a user 5 (or caregiver) in pulling the underwear up over a lower body of the user 5. The device 100 may be particularly useful in enabling the lower body garment 10 (or underwear) to be pulled over a widest part (circumference) of the lower body of the user 5 (again, such as the buttocks). This pulling up action of the lower body garment 10 may be assisted with the use of a grabber tool 15, as shown in FIGS. 1-2.

It should be appreciated that the term "waistband" does not limit the lower body garment 10 (or underwear) to only garments that include a physical distinct 'band'—the term "waistband" is used herein to describe the upper most section of the lower body garment 10, as shown in FIGS. 1-4.

Figure 3:
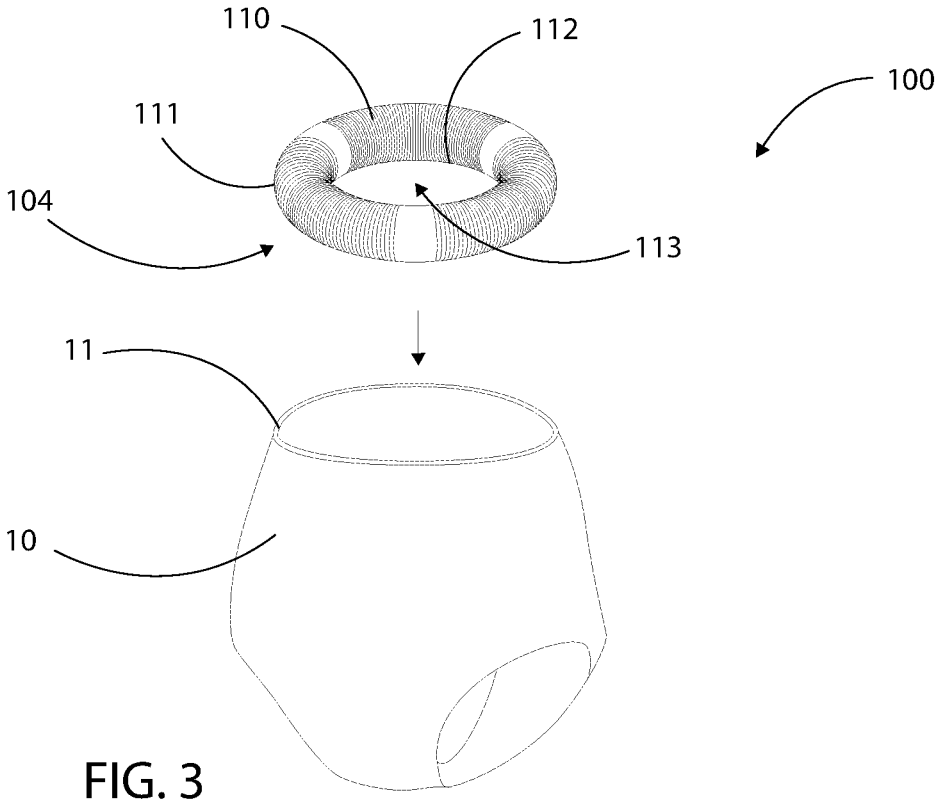
FIG. 3 is a front perspective view of the device in a retracted position for insertion into a waistband of the lower body garment, according to an embodiment of the present disclosure.
Figure 4:
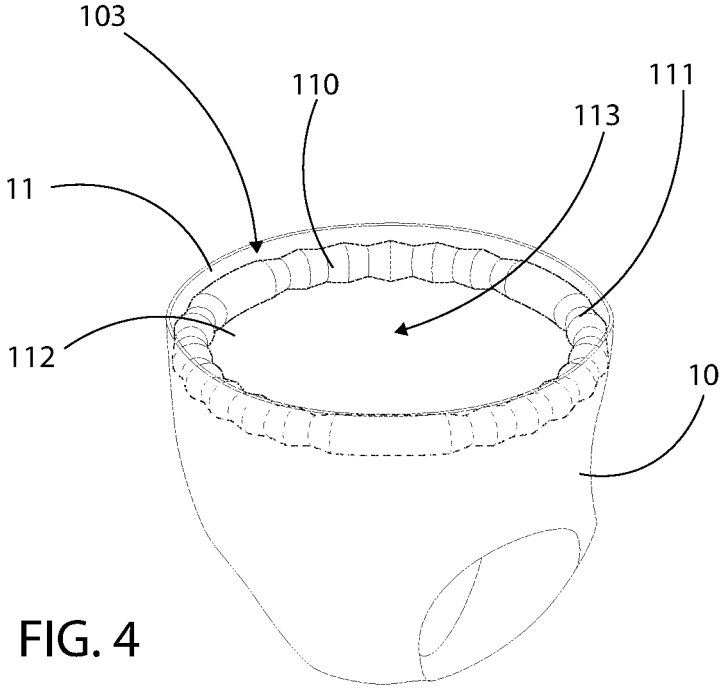
FIG. 4 is a front perspective view of the device inserted into the waistband and in an expanded position, according to an embodiment of the present disclosure.
Figure 5A:
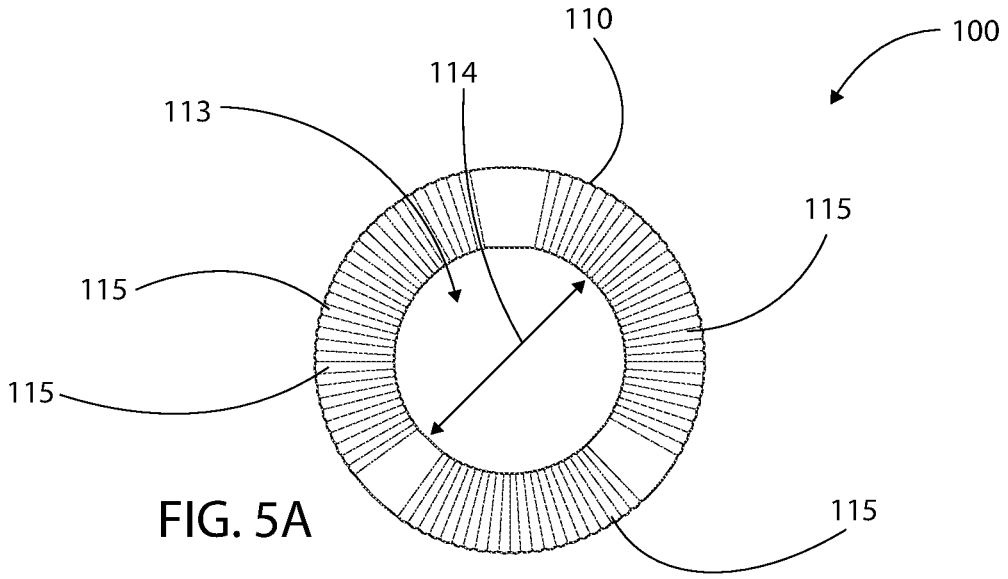
FIG. 5A is a top view of the device in the retracted position and including a plurality of movable members, according to an embodiment of the present disclosure.
Figure 5B:
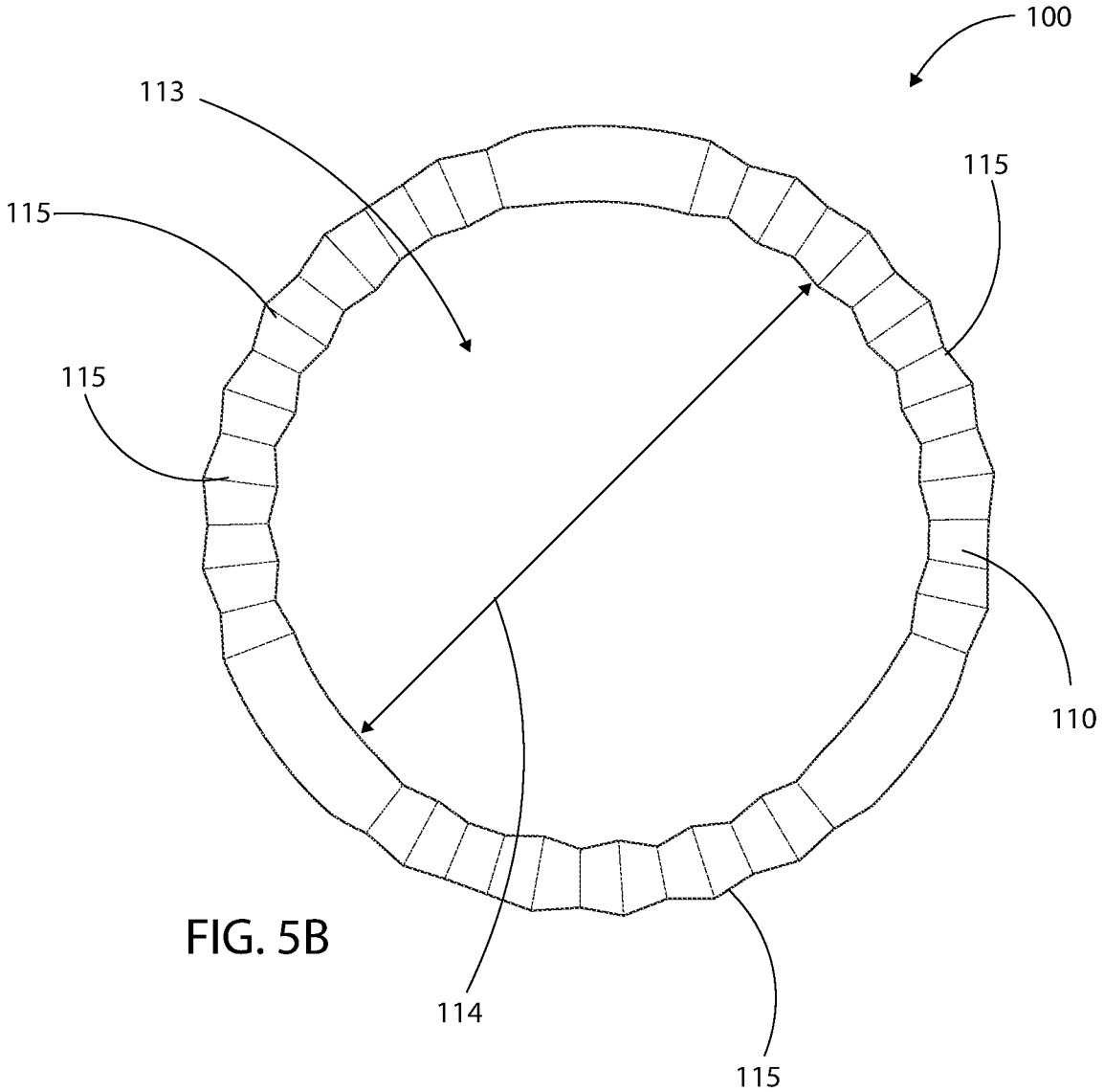
FIG. 5B is a top view of the device in the expanded position and having a larger diameter than in the retracted position, according to an embodiment of the present disclosure.

Referring more specifically now to FIGS. 3-8, the device 100 may include a generally annular body 110 including an outer circumference 111, an inner circumference 112 and a central opening 113 (bordered by the inner circumference 112) having a diameter 114 (FIGS. 5A-5B). As shown in these figures, the device 100 may be toroidal or annular. In some embodiments, the generally annular body 110 may include a thickness (the distance between the outer circumference 111 and the inner circumference 112) sufficient to enable the user 5 to grip the device 100, and particularly useful for user's 5 having limited grip strength. For example, the thickness may be (but is not limited to) between 1-3 inches. In some embodiments, the device 100 may be reusable. In these embodiments, the generally annular body 110 may be constructed from (but is not limited to) a plastic material. In other embodiments, the device 100 may be disposable. In these embodiments, the generally annular body 110 may be constructed from (but is not limited to) a bamboo material.

As shown in FIGS. 5A-8, the generally annular body 110 may be defined by a plurality of movable members 115 that may be interconnected together in such a way as to be mobile relative each other to enable radial expansion of the generally annular body 110 into an expanded position 103. In the expanded position 103, the diameter 114 of the central opening 113 may be of a size to accommodate the widest part (circumference) of the lower body of the user 5 (as shown in FIGS. 1-2) to easily move up and over the widest part of the lower body. For example, a circumference of the widest part of the lower body may measure 40 inches and as such, the diameter 114 of the central opening 113 may be expanded to 42 inches to allow the central opening 113 to easily move over the widest part of the lower body.

Similarly, the plurality of movable members 115 may enable radial contraction of the generally annular body 110 into a retracted position 104. In the retracted position 104, the diameter 114 of the central opening 113 may be smaller than the widest part of the lower body of the user 5 and smaller than the diameter 114 of the central opening 113 in the expanded position 103 as shown in FIGS. 5A-5B. More particularly, the retracted position 104 may place the device 100 in a compact state that is easily handled and stored. Accordingly, the device 100 may be configured to be inserted into the waistband 11 of the lower body garment 10 in the retracted position 104, as shown in FIG. 3, moved into the expanded position 103 within the waistband 11, as shown in FIG. 4, and then pulled over the widest part of the lower body.

Figure 6:
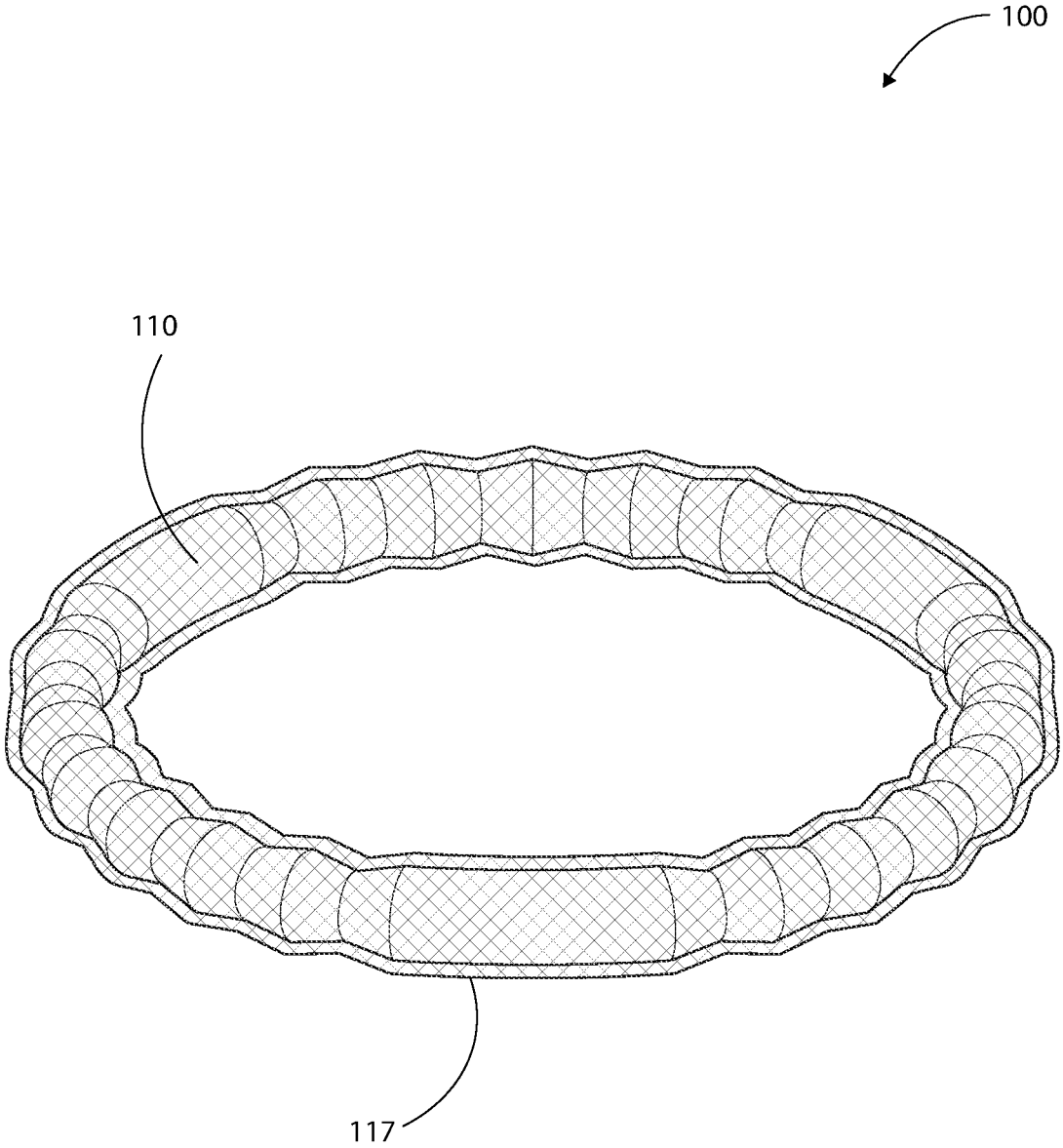
FIG. 6 is a front perspective view of the device encased in a mesh material, according to an embodiment of the present disclosure.
Figure 7:
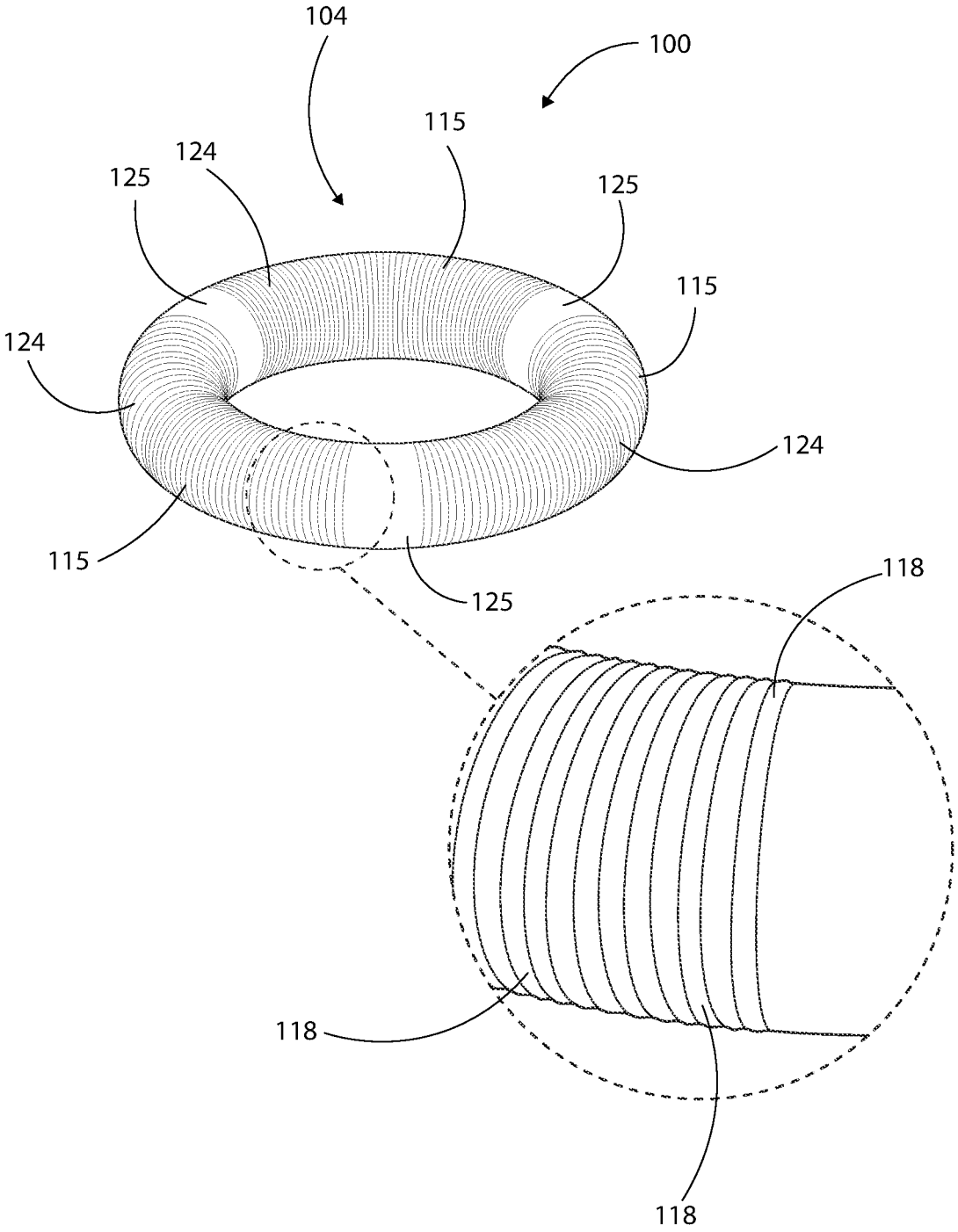
FIG. 7 is a detailed view of the device in the retracted position and illustrating a plurality of circumferentially rounded walls arranged in an accordion-like configuration, according to an embodiment of the present disclosure.

In some embodiments, to aid in keeping the device 100 within the waistband 11, the generally annular body 110 may be encased in a grip-enhancing material. For example, as shown in FIG. 6, the generally annular body 110 may be encased in a mesh material 117. This also may provided cushioning to the device 100.

As shown in FIGS. 1-8, the device 100 may be expanded and contracted in a similar fashion as an accordion. As such, as shown particularly in FIGS. 7-8, the plurality of movable members 115 may include a plurality of circumferentially rounded walls 118 interspersed with a plurality of flexible hinges 116 forming an accordion-like configuration. Further, in some embodiments, to aid in grip of the device 100 the generally annular body 110 may include at least two gripping sections. For example, the device 100 may include a plurality of accordion sections 124 (made up of the movable members 115) interspersed with a plurality of non-accordion sections (the gripping sections) 125. The plurality of non-accordion sections 125 may be rigid (in contrast with the accordion sections 124 which may be substantially flexible) and may have a smooth or non-slip surface. This may aid in grip of the device 100, as the rigidity of the plurality of non-accordion sections 125 may prevent the device 100 from deforming (caving inward) when grasped by the user 5.

In some embodiments, the plurality of non-accordion sections 125 may be integral to the plurality of accordion sections 124. Particularly, each of the plurality of accordion sections 124 may include a non-accordion section 125 thereon. Further, in some embodiments, the plurality of accordion sections 124 (and thus the non-accordion sections 125) may be connected together and able to be disassembled. In these embodiments, a number of the accordion sections 124 and the non-accordion sections 125 may be adjusted. This may be useful to adjust the device 100 based on size of the user 5. In some examples, the plurality of accordion sections 124 may be hollow and one end of each accordion section 124 may insert into an end of each adjacent accordion section 124.

It should be appreciated however that the device 100 is not limited to the configurations described above, nor is the device 100 limited to the accordion structure. For example, referring now to FIGS. 9A-9B, there is shown an alternative embodiment of the plurality of movable members 131. As shown, the plurality of movable members 131 may include an S-shape or a figure 8-shape (these figures show an example section of the plurality of movable members 131). As shown, each of the plurality of movable members 131 may include a top hook 121 and a bottom hook 122. The bottom hook 122 of each movable member 131 may be hooked onto the top hook 121 of each adjacent movable member 131 to form a looped chain of movable members 131 (thus forming a generally annular body). In this embodiment, in the retracted position 106 the movable members 131 may be abutted together, as shown in FIG. 9A; and in the expanded position 107 the movable members 131 may be pulled apart, with each of the movable members 131 being moved away from each other whilst remaining hooked, as shown in FIG. 9B.

Figure 10:
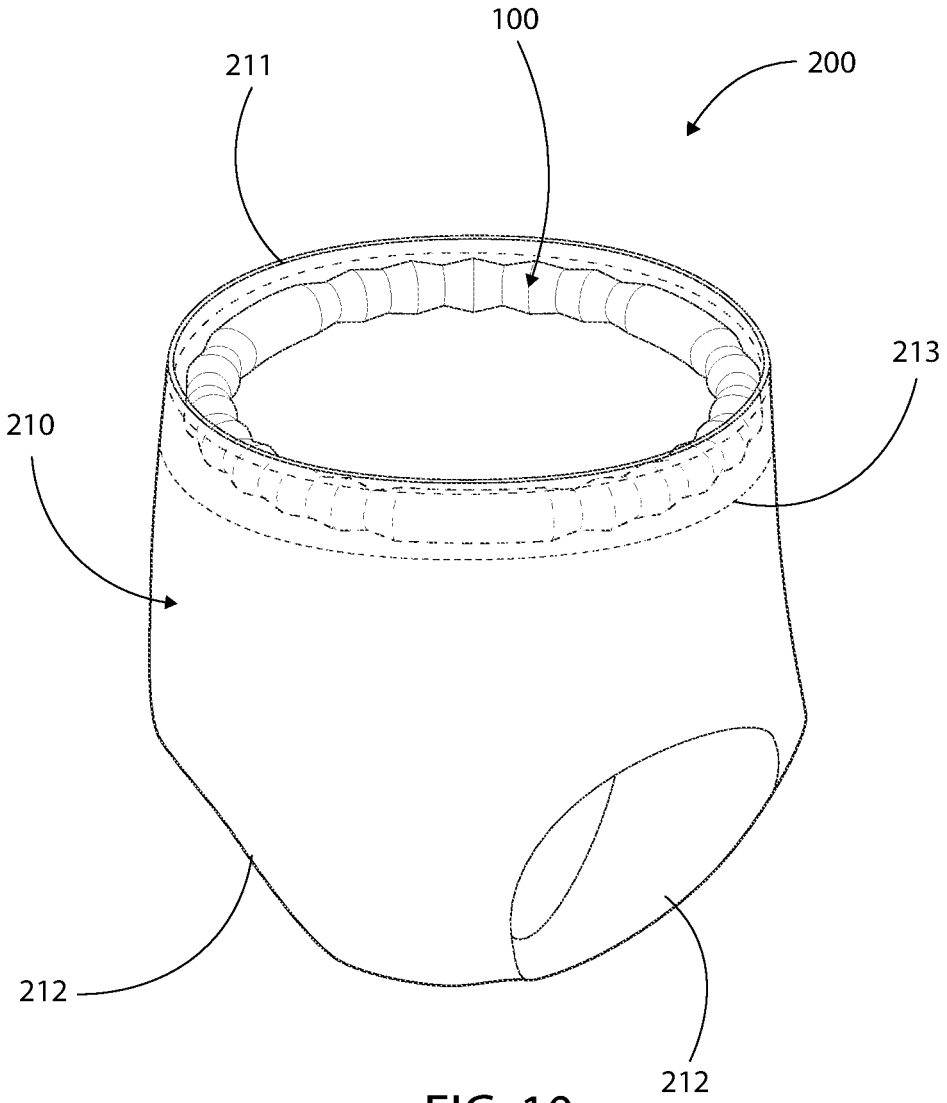
FIG. 10 is a front perspective view of an underwear donning system including an underwear garment and the device held in a waistband thereof via a tear-away seam, according to an embodiment of the present disclosure.

Referring now to FIG. 10, in some embodiments, an underwear garment system 200 may be provided comprising an underwear garment 210 and the device 100 as above (and as shown in FIGS. 1-8). The underwear garment 210 may include a waistband 211 and a pair of leg holes 212. The generally annular body 221 may be disposed in the waistband 211 of the underwear garment 210 and held therein via a tear-away seam 213. For example, the device 100 may be lightly sewn into the waistband 211 via a lightweight or perforated thread.

Figure 11:
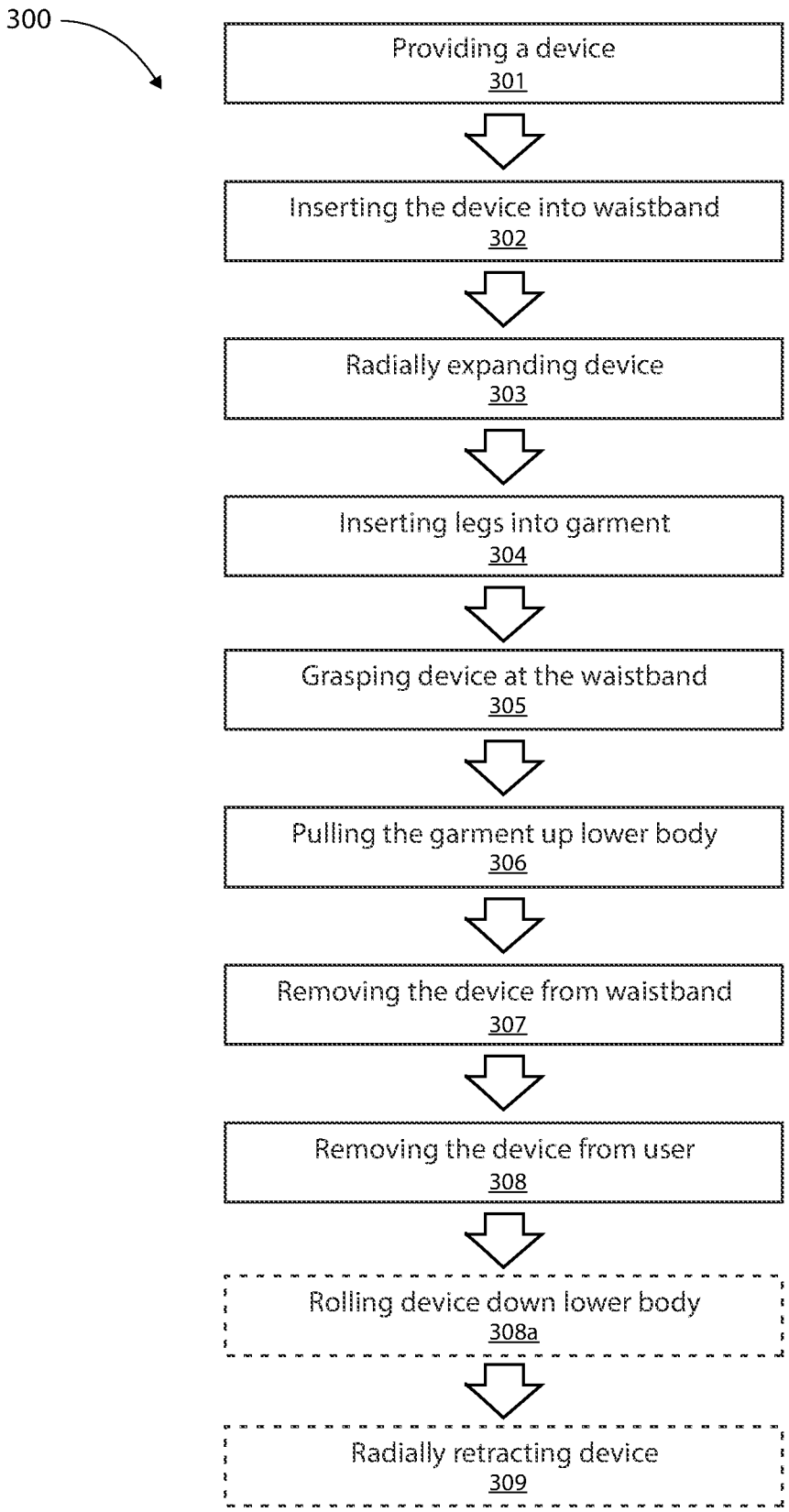
FIG. 11 is a flow diagram illustrating a method of putting on a lower body garment on a user, according to an embodiment of the present disclosure.

Referring now to FIG. 11 showing a flow diagram illustrating a method 300 of putting on a lower body garment on a user, according to an embodiment of the present disclosure. In particular, the method 300 may include one or more components or features of the device 100 and/or the underwear donning system 200 as described above. As illustrated, the method 300 may include the steps of: step one 301, providing the device as above; step two 302, inserting the device into a waistband of the lower body garment when in the retracted position; step three 303, radially expanding the generally annular body into the expanded position whereby the diameter of the central opening is of a size to accommodate a widest part of a lower body of the user; step four 304, inserting legs of the user through leg holes of the lower body garment; step five 305, grasping the device at the waistband of the lower body garment; step six 306, pulling the lower body garment up and over the widest part of the lower body of the user; step seven 307, removing the device from the waistband of the lower body garment; and step eight 308, removing the device from the user.

In some embodiments, step eight 308 may include rolling 308 a the device down the lower body of the user. Further, as above, the step of pulling the lower body garment up (step five 305) may be achieved via a grabber tool. In addition, as discussed above, the device may be provided as part of the underwear donning system. In this embodiment, the step of removing the device from the waistband (step six 306) may include breaking the tear-away seam. A further step may also include: step nine 309, radially retracting the generally annular body into the retracted position, thereby placing the device in a compact state.

It should be noted that certain steps are optional and may not be implemented in all cases. Optional steps of method 300 are illustrated using dotted lines in FIG. 11 so as to distinguish them from the other steps of method 300. It should also be noted that the steps described in the method of use can be carried out in many different orders according to user preference. It should be noted that the steps described in the method of use can be carried out in many different orders according to user preference. The use of "step of" should not be interpreted as "step for", in the claims herein and is not intended to invoke the provisions of 35 U.S.C. § 112 (f). It should also be noted that, under appropriate circumstances, considering such issues as design preference, user preferences, marketing preferences, cost, structural requirements, available materials, technological advances, etc., other methods are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable relevant patent offices and the public generally, and especially the scientist, engineers and practitioners in the art who are not familiar with patent or legal terms or phraseology, to determine quickly from a cursory inspection the nature and essence of the technical disclosure of the application.

What is claimed is:

1. A device for assisting a user in putting on a lower body garment, the device comprising:

a generally annular body including a central opening having a diameter, the generally annular body defined by a plurality of movable members;

wherein the plurality of movable members are interconnected together in such a way as to be mobile relative each other, enabling radial movement of the generally annular body from a retracted position to an expanded position;

wherein in the expanded position, the diameter of the central opening is of a size to accommodate a widest part of a lower body of the user;

wherein the plurality of movable members include a plurality of circumferentially rounded walls interspersed with a plurality of flexible hinges, generally forming an accordion-like configuration; and wherein the generally annular body is encased in a mesh material.

2. The device of claim 1, wherein the device is reusable, wherein the generally annular body is constructed from a plastic material, and wherein the plurality of movable members further configured to enable the generally annual body to move from the expanded position back to the retracted position.

3. The device of claim 1, wherein the device is disposable and wherein the generally annular body is constructed from a bamboo material.

4. A device for assisting a user in putting on a lower body garment, the device comprising:

a generally annular body including a central opening having a diameter, the generally annular body defined by a plurality of movable members;

wherein the plurality of movable members are interconnected together in such a way as to be mobile relative each other, enabling radial movement of the generally annular body from a retracted position to an expanded position;

wherein in the expanded position, the diameter of the central opening is of a size to accommodate a widest part of a lower body of the user;

wherein the plurality of movable members include a plurality of circumferentially rounded walls interspersed with a plurality of flexible hinges, generally forming an accordion-like configuration; and wherein the generally annular body includes at least two gripping sections interspersed with the plurality of movable members.

Figure 8:
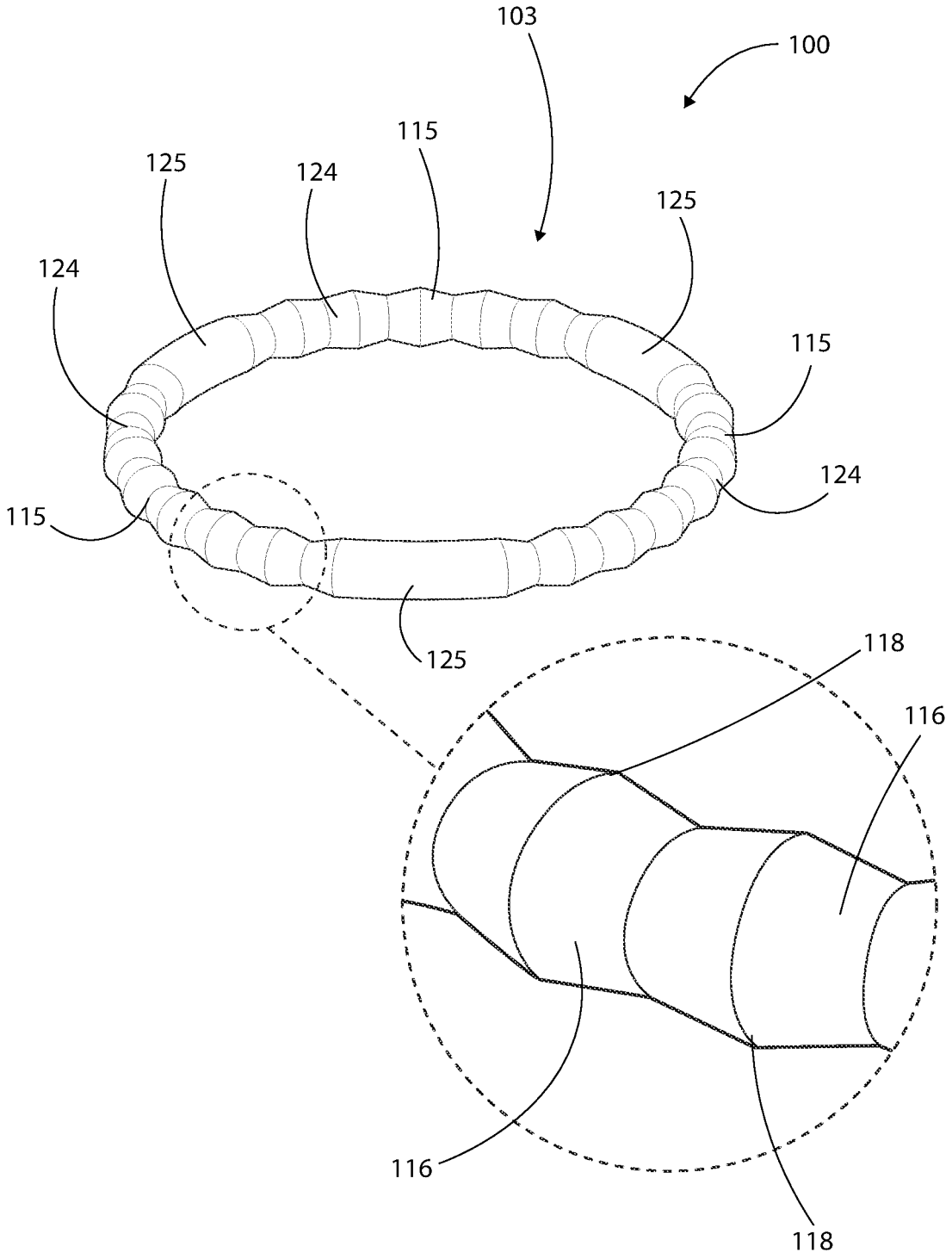
FIG. 8 is a detailed view of the device in the expanded position and illustrating the plurality of circumferentially rounded walls interspersed with a plurality of flexible hinges in the accordion-like configuration, according to an embodiment of the present disclosure.
Figure 9A:
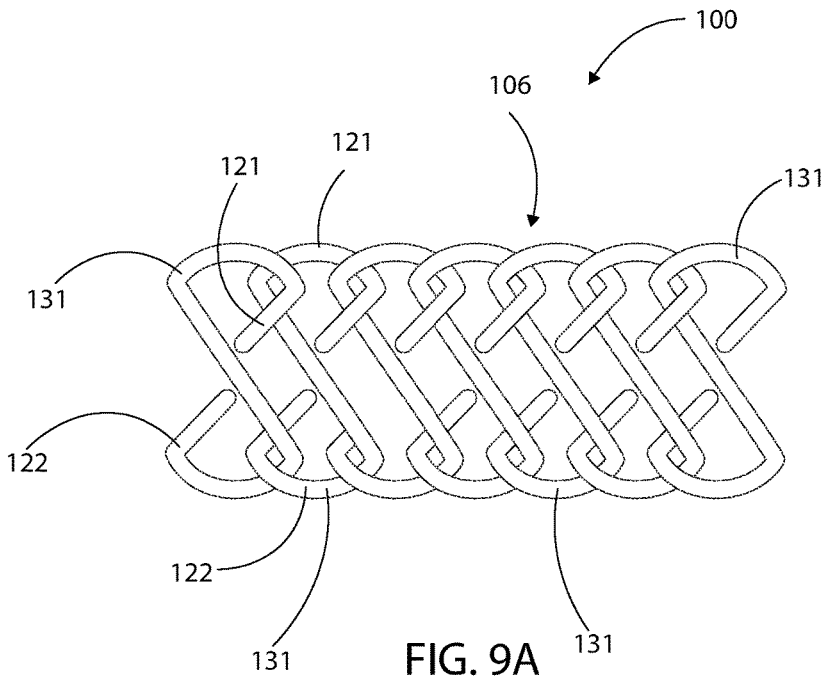
FIG. 9A is a top view of a section of the plurality of movable members each including an "S" or figure 8-shape, according to another embodiment of the present disclosure.
Figure 9B:
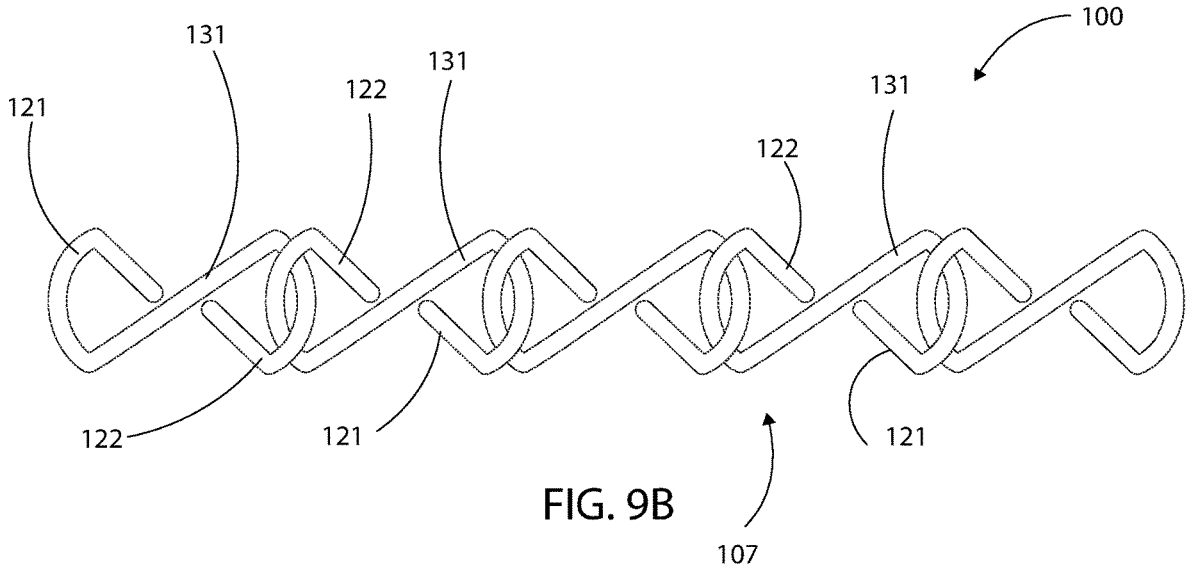
FIG. 9B is a top view of the section of the plurality of movable members of FIG. 9A in the expanded position, according to another embodiment of the present disclosure.

5. A device for assisting a user in putting on a lower body garment, the device comprising:

a generally annular body including a central opening having a diameter, the generally annular body defined by a plurality of movable members;

wherein the plurality of movable members are interconnected together in such a way as to be mobile relative each other, enabling radial movement of the generally annular body from a retracted position to an expanded position;

wherein in the expanded position, the diameter of the central opening is of a size to accommodate a widest part of a lower body of the user; and wherein the plurality of movable members each include one of an S-shape and a figure 8-shape having a top hook and a bottom hook, and wherein the bottom hook of each movable member is hooked onto the top hook of each adjacent movable member to form the generally annular body.

6. An underwear donning system comprising:

an underwear garment including a waistband and a pair of leg holes; and a device disposed in the waistband of the underwear garment and held therein via a tear-away seam, the device including a generally annular body having a central opening including a diameter, the generally annular body defined by a plurality of movable members;

wherein the plurality of movable members are interconnected together in such a way as to be mobile relative each other, enabling radial movement of the generally annular body from a retracted position to an expanded position; and wherein in the expanded position, the diameter of the central opening is of a size to accommodate a widest part of a lower body of the user.

7. The underwear donning system of claim 6, wherein the plurality of movable members include a plurality of circumferentially rounded walls interspersed with a plurality of flexible hinges, generally forming an accordion-like configuration.

8. The underwear donning system of claim 7, wherein the generally annular body is encased in a mesh material.

9. The underwear donning system of claim 6, wherein the device is reusable, and wherein the generally annular body is constructed from a plastic material, and wherein the plurality of movable members are further configured to enable radial movement of the generally annual body from the expanded position back to the retracted position.

10. The underwear donning system of claim 6, wherein the device is disposable, and wherein the generally annular body is constructed from a bamboo material.

11. The underwear donning system of claim 7, wherein the generally annular body includes at least two gripping sections interspersed with the plurality of movable members.

12. The underwear donning system of claim 6, wherein the plurality of movable members each include one of an S-shape and a figure 8-shape having a top hook and a bottom hook, and wherein the bottom hook of each movable member is hooked onto the top hook of each adjacent movable member to form the generally annular body.

13. A method of putting on a lower body garment on a user, the method comprising the steps of:

providing a device including:

a generally annular body including a central opening having a diameter, the generally annular body defined by a plurality of movable members, the plurality of movable members interconnected together in such a way as to be mobile relative each other to enable radial movement of the generally annular body between an expanded position and a retracted position;

inserting the device into a waistband of the lower body garment when in the retracted position;

radially expanding the generally annular body into the expanded position whereby the diameter of the central opening is of a size to accommodate a widest part of a lower body of the user;

inserting legs of the user through leg holes of the lower body garment;

grasping the device at the waistband of the lower body garment;

pulling the lower body garment up and over the widest part of the lower body of the user;

removing the device from the waistband of the lower body garment; and removing the device from the user.

14. The method of claim 13, wherein the step of removing the device from the user includes:

rolling the device down the lower body of the user.

15. The method of claim 13, further comprising the step of:

radially retracting the generally annular body into the retracted position, thereby placing the device in a compact state.

* * * * *